United States Patent [19]

Warren et al.

[11] 4,201,047

[45] May 6, 1980

[54] LOW EMISSION COMBUSTORS

[76] Inventors: Glenn B. Warren, 1361 Myron St., Schenectady, N.Y. 12309; J. Randolph Morgan, 13248 N. Avenue Victor Hugo, Phoenix, Ariz. 85032

[21] Appl. No.: 893,451

[22] Filed: Apr. 4, 1978

Related U.S. Application Data

[63] Continuation of Ser. No. 694,907, Jun. 10, 1976, abandoned.

[51] Int. Cl.[2] ..... F02G 3/02; F02B 19/02

[52] U.S. Cl. ..... 60/39.63; 60/39.28 R; 60/755; 60/760

[58] Field of Search ..... 60/39.06, 39.6–39.63, 60/39.65, 39.71, 39.74 R, 39.28 R; 123/122 G, 179 H

[56] References Cited

U.S. PATENT DOCUMENTS

| | | | |
|---|---|---|---|
| 2,160,218 | 5/1939 | Kingston et al. | 60/39.63 |
| 2,275,543 | 3/1942 | Meyer | 60/39.69 |
| 2,579,614 | 12/1951 | Ray | 60/39.65 |
| 2,636,553 | 4/1953 | Ballantyne | 60/39.28 R |
| 2,659,201 | 11/1953 | Krejci | 60/39.65 |
| 2,819,757 | 1/1958 | Greenland | 60/39.28 R |
| 3,099,134 | 7/1963 | Calder | 60/39.65 |
| 3,577,729 | 5/1971 | Warren | 60/39.63 |
| 3,736,747 | 6/1973 | Warren | 60/39.65 |
| 3,811,277 | 5/1974 | Markowski | 60/39.69 |
| 3,973,390 | 8/1976 | Jeroszko | 60/39.71 |

FOREIGN PATENT DOCUMENTS

| | | | |
|---|---|---|---|
| 603918 | 6/1948 | United Kingdom | 60/39.65 |
| 669751 | 4/1952 | United Kingdom | 60/39.65 |

*Primary Examiner*—Robert E. Garrett
*Attorney, Agent, or Firm*—Joseph V. Claeys

[57] ABSTRACT

A new and improved low emission combustor comprises a plurality of concentric cylindrical shells spaced radially to provide air supply and cooling passages and a primary fuel supply means disposed at the inlet end and a secondary fuel supply means disposed at the outlet end and arranged so that fuel supplied by the primary fuel supply means is less than that required for full load operation and the remainder of the fuel required to full load being supplied as needed by the secondary fuel supply means. Regeneratively heated combustion and cooling air is provided at the inlet and exit ends of the combustion chamber and at various intermediate locations along the length thereof to effect staged combustion and flame cooling.

10 Claims, 14 Drawing Figures

| | SECTION | A | B | C | D | E | F | G | H | I | J | J' |
|---|---|---|---|---|---|---|---|---|---|---|---|---|
| CUMULATIVE AIR #/MIN | FIG. 3 | 1.65 | 2.0 | 2.35 | 2.70 | 3.05 | 3.40 | 3.75 | 4.1 | 4.45 | 4.8 | 3.2 |
| | FIG 4 | 3.3 | 4.0 | 4.7 | 5.4 | 6.1 | 6.8 | 7.5 | 8.2 | 8.9 | 9.0 | 6.2 |
| | FIG. 5 | 4.76 | 5.72 | 6.68 | 7.65 | 8.62 | 9.58 | 10.54 | 11.50 | 12.47 | 13.45 | 9.0 |
| | FIG. 6 | 6.46 | 7.82 | 9.18 | 10.54 | 11.90 | 12.26 | 13.52 | 14.88 | 16.24 | 17.60 | 12.6 |

LOW EMISSION COMBUSTORS

This is a continuation, of application Ser. No. 694,907, filed June 6, 1976, now abandoned.

BACKGROUND OF THE INVENTION

This invention relates generally to combustors and methods of operation thereof and more particularly to combustors which are capable of operating with low pollution and at high temperatures, high pressures and, at high efficiencies over wide ranges of operating conditions. The present invention has a wide range of applications and is especially well suited for use as the external combustion system in a reciprocating piston engine of the type described in Warren's U.S. Pat. No. 3,577,739 and will be described in more detail in that connection; the disclosure of such patent being incorporated herein by reference.

In order to provide a low polluting combustor and one which can attain high efficiencies over wide ranges of operating conditions, wherein large amounts of energy are released per unit volume, the problems of excessive flame temperature, impingement on structural members and of excessive heat loss must be avoided. Excessive flame temperatures may result in local temperature levels which may be so high as to cause structural damage to the combustor and also may cause the production of large quantities of oxides of nitrogen (NOx). In instances where cooling means had been provided in the prior art combustors excess heat losses, incomplete combustion and lowered operating efficiencies had been incurred. The new and improved combustor of Warren U.S. Pat. No. 3,736,747 overcame these problems to a great extent by dividing the combustion chamber into a plurality of effectively separate primary, secondary and tertiary combustion zones; air to the primary zone being controlled to provide a fuel-rich flame and the air to the secondary and tertiary zones controlled to complete the combustion process in staged combustion. The combustor further included means whereby portions of the flame in the respective zones is regenerately cooled and contained along the longitudinal center portion of the combustion chamber. That is, the heat removed from the flame was returned to the secondary and tertiary zones with the air supplied thereto thereby providing high overall efficiency.

While the combustor of Warren U.S. Pat. No. 3,736,747 offered significant advantages, there is a continuing need for further improvements in combustors to provide still higher operating efficiencies over a wide range of operating conditions and with low air polluting emissions.

Accordingly, it is an object of this invention to provide a new and improved low emission combustor capable of operation at high temperatures and over wide ranges of load conditions and at high efficiency.

It is another object of this invention to provide a new and improved low emission combustor having regenerative flame cooling means whereby a high space heat release rate of combustion is obtained while maintaining a flame temperature level which is relatively low and by minimizing the heat loss, maintaining high operating efficiency.

The various novel features of this invention combine to provide a new and improved combustor having a great many important advantages including:

(1) Minimum heat losses at all loads, and particularly at high loads and near stoichiometric conditions consistent with viable metal temperatures in structural elements;

(2) Operable over a wide range of Air to Fuel ratios;

(3) Ease of compensating for relative motion of inner and outer liners at points where the spark plugs penetrate;

(4) Complete counter flow of incoming air to reduce loss of heat to the outer housing and to permit the outer housing to be operated at temperatures such that pressure can be sustained with low alloy steels.

(5) Swirling air and combustion gas flow which causes the hottest gases to seek the centerline of the combustion chamber and cooler uncombusted air to seek the walls so as to reduce heat losses and maintain cooler wall surfaces. This precludes development of high hydrocarbons (CH) on starting.

(6) Fins on the outer surface of the flame tube insure cooler walls and increased radiation and conduction losses of heat from over rich primary flame to thereby reduce NOx formation.

(7) Spaced-apart grouping of helical fins so that the frequent circular interruptions insures even distribution of flame tube wall temperature and maximum pick up of heat from fins as a result of frequent breaking up of the boundary layer of cooling air on the fins.

(8) Fuel injection nozzle means one at each end of the combustion chamber permit; (a) the regeneratively cooled and ignition portions of the combustor to be operated at overall equivalence ratio of never more than about 0.45 for naturally aspirated engines and 0.3 to 0.4 for supercharged engines; and (b) with the combustion of fuel in excess of this from the secondary injection nozzle located in the short, water cooled, section and ahead of and through the exit tubes, (and through the engine inlet valves if necessary), and (c) minimum loss of heat and the maximum possible regeneratively cooled wall area exposed to the primary combustion, thus insuring low Nox emissions at lower loads.

(9) Simplicity of construction.

(10) Ease of assembly and disassembly.

(11) The final combustion at high loads in a separate combustion space at the exit or engine end of the combustor from the No. 2 injector means that this combustion takes place in an atmosphere high in $CO_2$ and $H_2O$ from the primary combustion. This is equivalent to combustion with a high percentage of exhaust gas recirculation (EGR) based upon experience in the industry this means low production of NOx. The high turbulence induced by the intermittent flow to the inlet valves with high excess air and high temperatures will insure low CO and CH's in the exhaust.

Briefly stated, in accordance with one aspect of this invention, a new and improved combustor of the type having a plurality of concentric cylindrical shells spaced radially to provide air cooling and supply passages is provided with a primary fuel supply means at the inlet end of the combustor and a secondary fuel supply means at the exit end thereof. The primary fuel supply means is arranged and adapted to supply fuel for operation at less than full load with the secondary fuel supply means being arranged and adapted to supply to remainder of the fuel required to achieve operation up to full load. Preferably, the primary fuel supply means supplies up to 50% of the fuel required for full load operation.

In accordance with another aspect of the invention, the new and improved combustor includes an outer housing, preferably thermally insulated, and a pair of liners arranged concentrically therein and in radially spaced relationship to provide an air passage there between. The inner liner serves as the combustion chamber or "flame tube" and has a plurality of circumferentially spaced, axially extending, tangentially and radially directed openings in its wall. A controlled quantity of air is delivered in a swirling motion through openings at the inlet end of the flame tube after passing through the air passage means and taking up some heat from the flame tube and the adjacent concentric liner and keeping the outer pressure retaining outer housing at nearly incoming air temperature. A controlled quantity of fuel, less than that required for full load operation is supplied through a primary fuel supply means at the inlet end of the flame tube where it mixes with the swirling air and is ignited to establish a fuel-rich swirling primary combustion. The remainder of the air is passed through the air passage means taking up heat from the preferably suitably finned flame tube and passing through the openings in the flame tube wall and through passages at the outlet end of the flame tube to provide the secondary and tertiary combustion air. The combustor also includes a secondary fuel supply means disposed at the outlet end of the flame tube to provide a controlled quantity of fuel as required to obtain operation to the higher load conditions. In a particular preferred arrangement about 50% of the total fuel required for full load operation is supplied by the primary fuel supply means with the remainder supplied as required to full load operation by the secondary fuel supply means.

For applications such as for gas turbines, where it is desired not to confine the hot combustion products to a hot central core at the outlet, the fin means in the air passage and/or the openings in the wall of about the last one third of the flame tube may be arranged and the openings admitting tertiary air may be suitably inclined to impart to the air provided to the tertiary combustion zone a helical motion in the direction opposite to that provided at the inlet end. The consequent reduction in circular momentum of the gases and resultant turbulent mixing of the hot combustion products provides hot gases at the outlet which have a more uniform temperature across the combustion chamber. This is essential in a gas turbine to preclude burning of the blading system by a hot gas core. The hot gas core, however, is an advantage in a liquid-cooled reciprocating engine such as that of U.S. Pat. No. 3,577,739 since it reduces the heat losses to the liquid cooling jacket.

DESCRIPTION OF THE DRAWINGS

The novel features believed characteristic of this invention are set forth with particularity in the appended claims. The invention itself, however, both as to its organization and method of operation together with further objects and advantages thereof may best be understood by reference to the following description taken in conjunction with the accompanying drawings, and in which:

FIG. 1 (*a*) is a section view taken in the direction a—a of FIG. 1;

FIGS. 3 (*a*) through 5 (*a*) are section views taken in the direction a—a of each of the respective FIGS. 3 through 5;

FIG. 6 (*a*) is a section view taken in the direction a—a of FIG. 6;

DETAILED DESCRIPTION OF THE INVENTION

Figure 1:
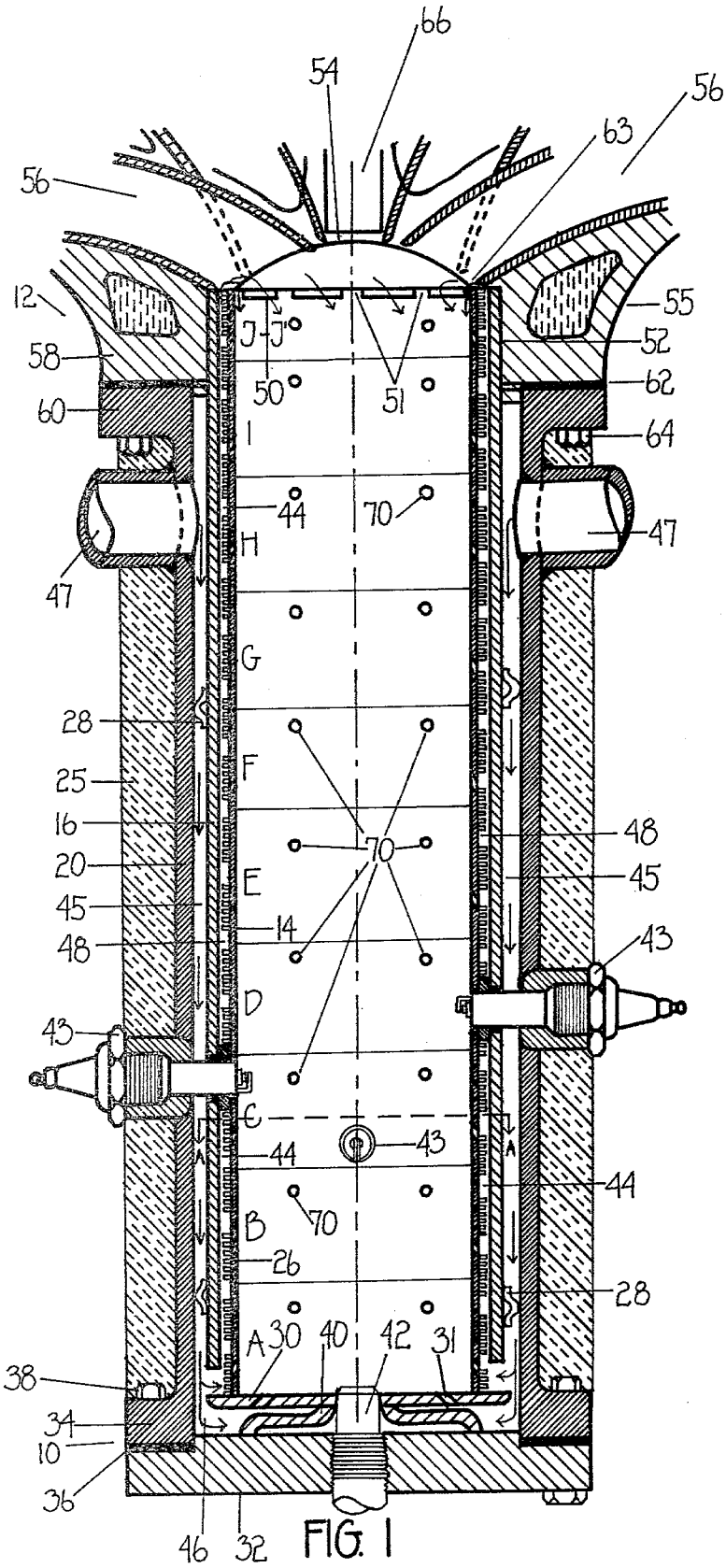
FIG. 1 is a horizontal section view of one embodiment of the combustor of this invention.

Referring now to the drawings, in FIG. 1 there is illustrated a combustor in accordance with one embodiment of the invention. As shown, the combustor has an inlet end 10 and an outlet end 12 and comprises an inner wall or flame tube 14. A concentric shell member 16 disposed in radially spaced relation about the flame tube 14, and an outer housing shell member 20, which carries the internal gas pressure containment stresses, is radially spaced and disposed concentrically about the shell member 16 so as to surround the flame tube 14 and the shell member 16. Preferably, outer layer 25 of thermal insulation material may be provided around outer housing shell member 20 to still further reduce the heat loss and prevent underhood heating when the combustor is employed in automotive applications.

The shell member 16 is held in the desired radial spaced relation by the combination of fin means 26 on the outer surface of flame tube 14 and a plurality of spring members 28 disposed in circumferentially and axially spaced relationship in the space between the shell member 16 and housing shell member 20. The spring members 28 may be welded or otherwise suitably secured to the shell member 16. Accordingly, the spring members 28 resiliently urge the shell member 16 against the outer surface of fin means 26 of flame tube 14. The resilient support arrangement is simple and convenient and allows for the expansion and contraction of the shell members relative to each other during operation, and ease of assembly and maintenance operations.

Figure 1A:
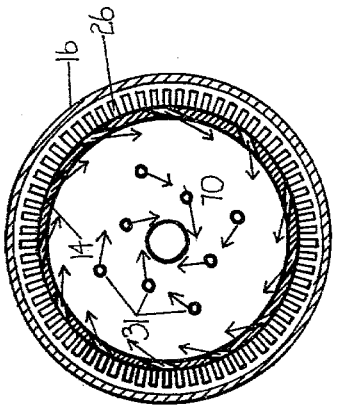

The inlet end of flame tube 14 is closed by an inlet plate 30 having a plurality of openings 31 therein while the inlet ends of the shell member 1 end outer housing shell member 20 are closed by an inlet end closure member 32. Preferably, in a particular arrangement, there are 8 openings of 1/16 inch diameter arranged in two circles in inlet plate 30 and such openings are directed tangentially 45° and inwardly 30° as shown more clearly in FIG. 1*a*.

Conveniently, outer shell member 20 may terminate at the inlet end in a flange 34. Inlet and closure member 32 may then be secured to flange 34 with a suitable gasket seal 36 and plurality of bolts 38. The inlet plate 30 is held resiliently in place against the end of flame tube 14 by suitable spring means 40 disposed between the inlet plate 30 and the inside surface of closure member 32.

Disposed centrally in closure member 32 and inlet plate 30 is a primary fuel supply injector 42. One end of the fuel injector 42 extends into the inlet end of the flame tube 14 and the other end extends through the closure member 32 for connection with a suitable fuel supply (not shown). A plurality of spark plugs 43 are disposed circumferentially and in axially staggered relationship a short distance downstream from the inlet end of the flame tube 14. The radially disposed arrangement of four plugs shown in FIG. 1 is a convenient arrangement and provides for inspection and/or changing one plug at a time, and holds the several concentric cylinders on a common center.

The space between the shell member 16 and flame tube 14 forms an air passage 44. Also, the space between shell member 16 and housing 20 forms a second air passage 45 and, together with the space between the inlet plate 30 and closure member 32, forms a plenum chamber 46 to which air is supplied by one or more conduits 47 from any suitable source, such as an air compressor. If the combustor is employed with the reciprocating piston engine of Warren U.S. Pat. No. 3,577,729, conduit 47 may be connected with the air compressor provided by the other bank of reciprocating pistons of the engine. If the combustor is employed with a gas turbine engine, on the other hand, the air may be supplied by an air compressor driven by a turbine operated by hot gases from the combustor.

As illustrated, the shell member 16 does not extend all the way to the inlet plate 30. This allows the inlet end of the first air passage 44 between the shell member 16 and the flame tube 14 to communicate with the plenum chamber 46 so that air from the plenum chamber is delivered to passage 44. Preferably, the fin means 26 are disposed helically on the outside surface of flame tube 14 so that the air flowing in passage 44 has a swirling motion imparted to it. This also promotes uniform temperature along members 16 and 14.

Figure 2:
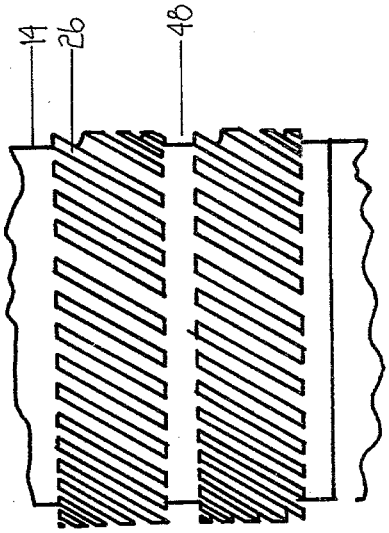
FIG. 2 is an outside view of a portion of the flame tube taken in the direction 2—2 of FIG. 1.

As illustrated more clearly in FIG. 2, the fin means 26 are helically arranged in spaced-apart groups on the outside of the flame tube 14 and along the length thereof. The fin means 26 thus extend into the space defined between the liner 16 and flame tube 14 and the helical arrangement provides a swirling motion to the air flowing in the air passage 44. The small spaces 48 between adjacent groups of fin means results in frequent breaking up of the boundary layer of the air on the fin means 26 improving the heat transfer and insuring a more even distribution of temperature of the flame tube 14.

To assure that the expansion and contraction of the flame tube 14 and shell member 16 does not cause spark plug breakage, the openings for the end of the spark plugs in flame tube 14 and shell member 16 are made larger than the ends of the spark plugs. A suitable movable seal means may be provided about the openings within the air passage 44 since too much air leakage past the spark plugs from passage 44 may prevent ignition and upset the helical swirling in the flame tube 14.

The outlet end of flame tube 14 is provided with a slot 50 having a plurality of projecting spacers 51 therein for permitting a passage of heated air which is then supplied to the utilization apparatus, such as a reciprocating piston engine or gas turbine, or serves to provide combustion air for burning fuel from fuel injector 66. In the arrangement illustrated in FIG. 1, where the combustor is illustrated as employed with a reciprocating piston engine, the outlet end of the flame tube 14 is shown disposed within a suitable opening 52 of the engine cylinder head 55. Opening 52 terminates in a spherical region 54. The cylinder head 55 is shown as being liquid cooled and includes a plurality of outlet passages 56 extending from spherical region 54. The passages 56 carry the combustion products to the valve-controlled engine cylinders. For example, a suitable inlet valve (not shown) is associated with each of the engine cylinders and controls the flow of the hot combustion products from a passage 56 to the engine cylinder.

Conveniently, cylinder head 55 is provided with a suitable mounting flange 58 to which the flange 60 at the outlet end of outer housing member 20 is secured by a suitable gasket seal 62 and plurality of bolts 64. Also, to provide a convenient means of holding the outlet end of the flame tube 14 and provide for good heat transfer to the cooling liquid of the engine, the fin means 26 may be fit size-on-size into the opening 50 of the engine cylinder head. As shown, flame tube 14 does not extend all the way to the end of the opening 50 so that air from the end of air passage 44 exits at the passages 63 into the spherical region 54 just in front of the outlet passages 56 which carry the combustion products to the engine cylinders. This air delivered through the passages 63 is the tertiary combustion air. In a particular arrangement the outlets 63 are arranged to deliver about 37% of the total combustion air to the region 54 just in front of the outlet passages 56. Another advantage of the combustor of the invention is that the gaskets between flanges 56 and 60 and flanges 32 and 34 are subjected only to slightly more than the incoming air temperature from pipes 47.

In accordance with another important feature of this invention a second fuel supply nozzle means 66 is provided at the outlet end of the flame tube 14 adjacent the outlet passages 56. Fuel is only supplied through nozzle 66 to provide for the higher output conditions. For example, only about 40% to 60% of the total fuel required to obtain full load operation is arranged to be supplied by the primary fuel nozzle 42 at the inlet end of flame tube 14 with the remaining 40% to 60% being supplied, as required, in a continuous flow through the secondary nozzle 66. That is, that portion of the fuel required to meet the load needs beyond 50% of the total fuel coming in through the primary fuel nozzle 42 is supplied, as needed, under suitable control, from the secondary fuel supply nozzle 66 which is located just in front of the outlet passages 56. When full load is required, the fuel from secondary injector means 66 will be all burned very rapidly in the volume just ahead of the outlet passage thus relieving the main combustion chamber and spark plugs of a heat load at high loads and near stoichiometric air-fuel ratios.

Since the flow through the outlet passages 56 under control of the engine inlet valves takes place one at a time, even distribution of the fuel from secondary fuel nozzle 66 is achieved. For example, this fuel is dragged in with each "gulp" of combustion products by an engine cylinder and, due to the accelerated helical swirl as the gases pass through the outlet passages 56, the unburned air is segregated near the circumference. The final combustion may be delayed somewhat until the mixture enters the outer tubes or even passes the engine inlet valve and may be completed at maximum loads in the top portion of the engine cylinder volume where the turbulance assures full combustion, as in a pre-chamber diesel engine, for example.

The wall of flame tube 14 is provided with a plurality of circumferentially spaced, axially extending, tangentially and radially directed openings 70. As shown previously, primary air is supplied through the openings 31 in inlet plate 30. The remaining primary and all of the secondary combustion air is admitted to the flame tube 14 from air passage 44 and through the openings 70. To continue the helical swirling motion of the combustion products in flame tube 14, the openings 70 are inclined inwardly, helically, tangentially and downstream. The size, number and distribution of the openings 70 are selected, arranged, and adapted to provide for the desired "staged combustion" in the primary, secondary and tertiary combustion zones within flame tube 14.

Most of the primary air is supplied to the inlet end of flame tube 14 through the openings 31 in inlet plate 30. To assure flame stability, some air is also delivered to the primary combustion zone from openings 70. The inflow of air through the openings 70 at the primary combustion zone provides a region of slightly elevated pressure thereby preventing flame blow-out during low output operation of the combustor. Also, in this primary combustion zone the amount of air delivered through the openings 31 in the inlet plate 30 and the openings 70 is controlled to provide for an extremely fuel-rich mixture. More air is then added downstream through the additional openings 70 to establish the secondary combustion, and the combination of the air through the remaining openings 70 and the outlets 63 at the outlet end of flame tube 14 establishes the tertiary combustion.

As described, the area of the openings 70 at the primary combustion zone together with the openings 31 in the inlet plate 30 and the size and spacing of the holes 70 are such as to stretch out the combustion in the primary combustion zone to permit a maximum of wall surface available for radiant cooling of the primary flame to minimize the production of NOx. That is, the fuel spray needs to reach out along the combustion chamber to reach enough air. The combustion in the center is thus kept in the rich condition.

The combustor of this invention is capable of attaining high combustion efficiency over a wide range of operating conditions and with low polluting emission. It is particularly suited to high output operation in which the exit gases may become very hot. While damaging temperatures may be obviated by providing a liquid cooling jacket for the combustor, the resulting loss of heat to the cooling liquid greatly lowers the combustor efficiency. It is an important feature of the invention, therefore, to provide means for providing both flame containing and cooling functions with little or no heat loss. This is accomplished in accordance with this invention by causing the combustion products to be swirled in a helical motion in all of the combustion zones while at the same time providing regenerative flame cooling and thermal insulation of the housing to minimize heat loss. That is, the heat transferred to the cooling air used to cool the combustion zone is returned to the combustion process at a point distant from the one at which it was removed with little or no heat loss. Also, by providing a thermally insulated combustor housing, heat loss through the walls of the combustor housing is minimized. Accordingly, the peak combustion temperature is reduced with little or no heat loss.

Moreover, since the quantity of oxides of nitrogen generated is generally determined by peak temperature levels of regions through which the combustion gases pass, the regenerative cooling and fuel-rich primary condition provided in the combustor of this invention will thus provide low oxide of nitrogen levels in the combustion products as will be described in more specific detail. Based upon available furnace radiation absorption data, the combustor of this invention results in reducing the primary combustion temperature from 300° to 500° below what it otherwise would be without the concentric shell arrangement. This insures low NOx values at cruising power despite high incoming air temperature and high combustion chamber pressures.

A combustor of this concentric shell type is inherently capable of producing combustion products which are low in CO and unburned hydrocarbons so long as excess air over stoichimetric is provided before the gas enters the engine cylinders. Unless special precautions are taken, however, the nitrogen oxide (NOx) components of the exhaust, although inherently lower than in an explosion cycle engine because of lower peak combustion temperature due to the higher gas specific heat with constant pressure combustion as contrasted with nearly constant volume combustion in conventional engines, might still be higher than permitted by the present or future Federal Air Pollution Standards for automotive engines.

Accordingly, the combustor of this invention is made to operate with the so-called "staged combustion technique". The principle of operation of such staged combustion so far as generation of low NOx is concerned depends upon the basic physics of such combustion in that the extent of NOx formation is first a power function of the temperature (probably fifth power) and second of the amount of excess oxygen available. This means that such NOx is a maximum at 10%–15% excess air over that required for stoichiometric. The amount of NOx is also a function of the dynamics or speed of flame formation which is also a drastic function of the temperatures at which the excess oxygen is made available. Considering these laws it follows that if, with an ultimate equivalence ratio at the outlet of say 0.7 (lean), the primary combustion zone is kept at an equivalence ratio of 1.2 (rich), the flame in such primary combustion zone is lower in temperature than stoichiometric and little or no excess oxygen is present. If this flame is further cooled by regenerative air cooled walls before the remainder of the combustion air is added to the secondary and tertiary combustion zones then, when it is added, the lower resulting temperature reduces both the extent of NOx formation by temperature alone, and also so slows down the oxidation process in time as to reduce the total NOx formed before the gases are further chilled by the prime mover into which they are delivered.

Figure 3:
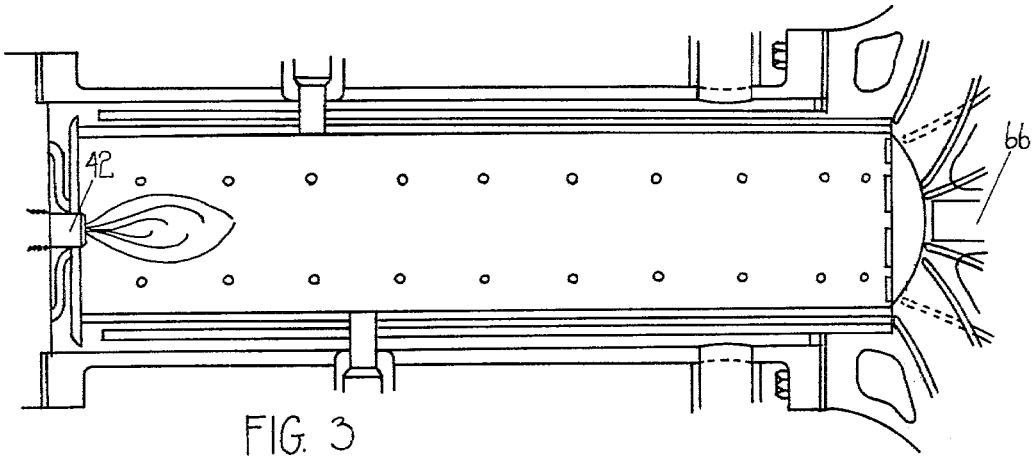
FIGS. 3 through 5 are schematic section views of the combustor to illustrate the operation thereof at different load conditions.
Figure 3A:
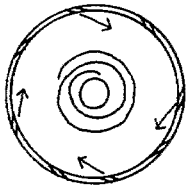

In operation at any given air flow the combustor output and exit temperature depends upon the quantity of fuel injected relative to the air flow. At low output it has been observed that the flame is therefore relatively small and is confined to the inlet end of the primary combustion zone of the combustion chamber within the flame tube 14, as shown in FIGS. 3 and 3*a*. The center of the flame can still be over-rich because of the core of fuel which has not reached enough air to burn lean. Under these operating conditions the primary air is adequate to provide ultimately complete combustion and the air delivered through the openings 70 and 63 to the secondary and tertiary combustion zones provide cooling. The temperatures of housing 20, flame tube 14, and shell member 16 are correspondingly low, and the small rich flame can be cooled by radiation to the surrounding air cooled walls.

Figure 4:
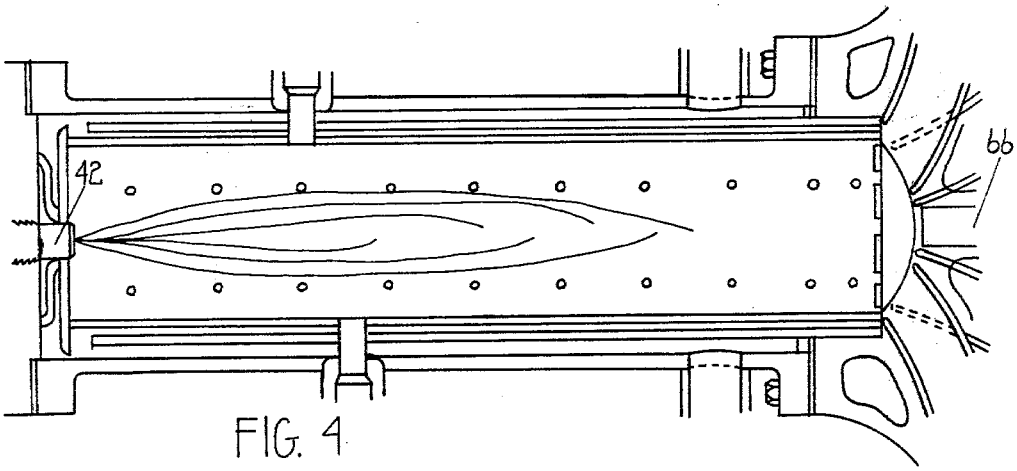
Figure 4A:
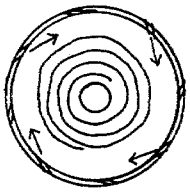

When the combustor operates at higher output, the flame region extends axially in the flame tube 14, as shown in FIGS. 4 and 4*a*. Under these operating conditions the air supplied to the primary combustion zone is insufficient for the combustion process and secondary and tertiary air are provided both for cooling and to complete the combustion. The temperatures of flame tube 14 and shell member 16 are correspondingly higher. By virtue of the lengthening out of the flame observed in helical swirls, this becomes, in effect, an elongated rich primary combustion zone.

Figure 5:
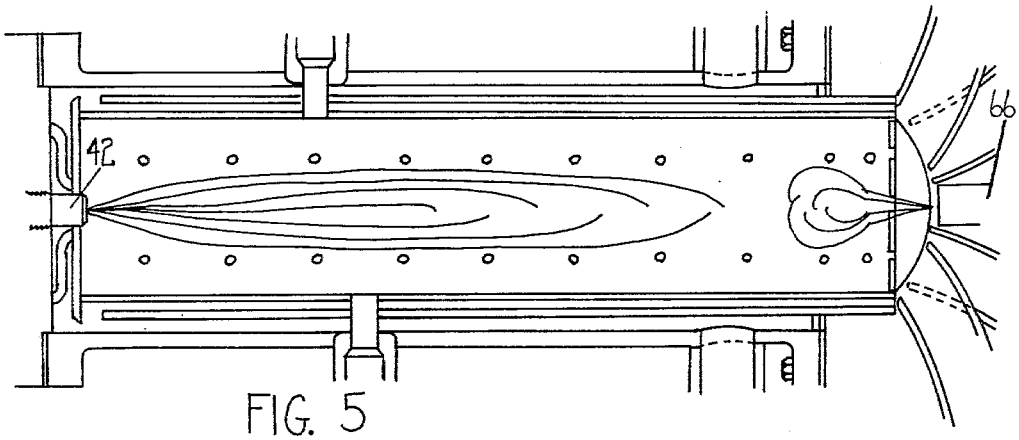
Figure 5A:
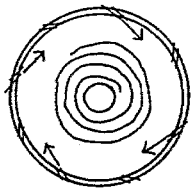

In operation, fuel and air are fed from fuel supply means 42 and inlet plate 30 into the primary combustion zone of flame tube 14. Ignition may be provided by spark plugs 43 or by any other suitable means. The air supplied to plenum chamber 46 enters the primary combustion zone in a swirling motion through suitable openings 31 in inlet plate 30. Plate 30 is provided with means, such as fins or suitably angled openings to provide this initial helical swirling motion to the air. The remainder of the air is supplied to the secondary and tertiary combustion zones through the openings 70 and passages 63. This action can be understood, for example, by observing that "primary" air is that required to sustain combustion under all operating conditions, while the "secondary" and "tertiary" air is that required to complete the combustion process in stage combustion, for modulation of the burning rate, and for cooling purposes. The real primary zone, therefore, moves further into the flame tube of the combustor as the load is increased, that is, as more fuel is injected as shown in FIGS. 3, 4 and 5.

The openings 31 in plate 30 are adapted to meter the air into the primary combustion zone of flame tube 14 and establish a fuel rich fuel-air mixture. They are adapted also to provide the desired helical motion to the primary air thus forming a primary vortex which cooperates in containing the combustion reaction away from the inside surface of the flame tube 14 by forming a helical vortex of hot gases within the longitudinal center thereof. In this regard, centrifugal force will urge the colder, relatively more dense, unreacted air towards the inside surface and the hot relatively light gases of the combustion reaction will be displaced or "floated" towards the center of the flame tube 14. The effect is similar to enclosing the combustion process in a "pipe" disposed along the axis of the combustion chamber; the "pipe" being formed by the swirling relatively colder air, sometimes referred to as the "curtain air". The heat acquired by flame tube 14 in effecting the desired flame cooling is returned to the secondary and tertiary air coursing over fin means 26 thereby preheating it. Accordingly, flame tube 14 is capable of providing the desired colder thermal environment for limiting the temperature in the primary combustion process thus limiting NOx formation while, at the same time, contributing towards an overall combustor heat economy by regenerative air heating through a wide range of load.

The secondary and tertiary air flows through the air passage 44 and enters the flame tube 14 at a point axially distant from the inlet end thereof. Fin means 26, which the secondary air traverses, and the openings 70 are arranged inclined and adapted to impart a helical motion to the air forming a secondary vortex in the same direction as the primary vortex. The secondary air not only aids in staged combustion but also assists in containing the hot combustion products away from the inside surface of the flame tube 14 in the manner described with respect to the primary vortex. Flame tube 14 consequently is capable of providing the desired lower temperature environment for the secondary and tertiary combustion process while, at the same time, contributing further towards an overall combustor heat economy by regenerative air heating.

As already described, combustion air control is an important feature in the combustor according to this invention. Variations in the rate of air flow provide variations in the combustion process and pattern and in the temperature levels of component members. An important feature is that the amount of air required for combustion is introduced into the combustion chamber as primary, secondary and tertiary air but varying in accordance with the degree of load. In a particular arrangement, good combustor performance is achieved, for example, when providing an approximate distribution of 15% primary air, 4% to 10% flame stabilizing air, 40% secondary air and about 35% tertiary air.

The distribution of air at all speeds and loads is substantially determined by the relative area of the holes 70 which feed air from the space 44 outside the flame tube 14 to the various sections of the combustion chamber. The total area of these holes determines the total pressure drop across the combustor at any given speed and load. It was determined that at maximum speed and load the pressure drop across this combustion chamber should be about 3%, or about 24 psi at 4000 rpm, and wide open throttle (WOT). This is but 2.1% at 3200 rpm and WOT. The rest of the pressure drop between compressor to engine is in the compressor exit and engine inlet valve.

The total area of the air passage holes 70 is relatively small compared to the combustion chamber itself for two reasons. First, the holes are small because of the high pressures and low flows of this engine compared to the normal gas turbine combustion pressures and flows. Calculations show that for these conditions the total area of the holes (assuming 75% flow coefficient) to be but 0.166 square inch for a 200 H.P. engine. The relatively large size of the combustion chamber is determined by the requirement for getting low emissions, particularly NOx. With the larger combustion chamber size there is more cooling of the rich primary, and probably more time for low CO and CH formation.

This distribution of air into the various regions of the flame tube 14 at different load conditions may best be explained by reference to FIGS. 3 through 6 which illustrate different operating conditions of one particular embodiment of the invention. For this explanation, assume that there is the following disposition of the incoming air; 15% around the primary fuel supply means 42, 4% around each of ten sections A through J of the chamber along its length (that is 40% in the main chamber), then 37% coming into the spherical region 54 just ahead of the No. 2 Injector, leaving 8% to cool or rather displace the hot gas from going up the 4 valve stems.

Figures 8, 9:
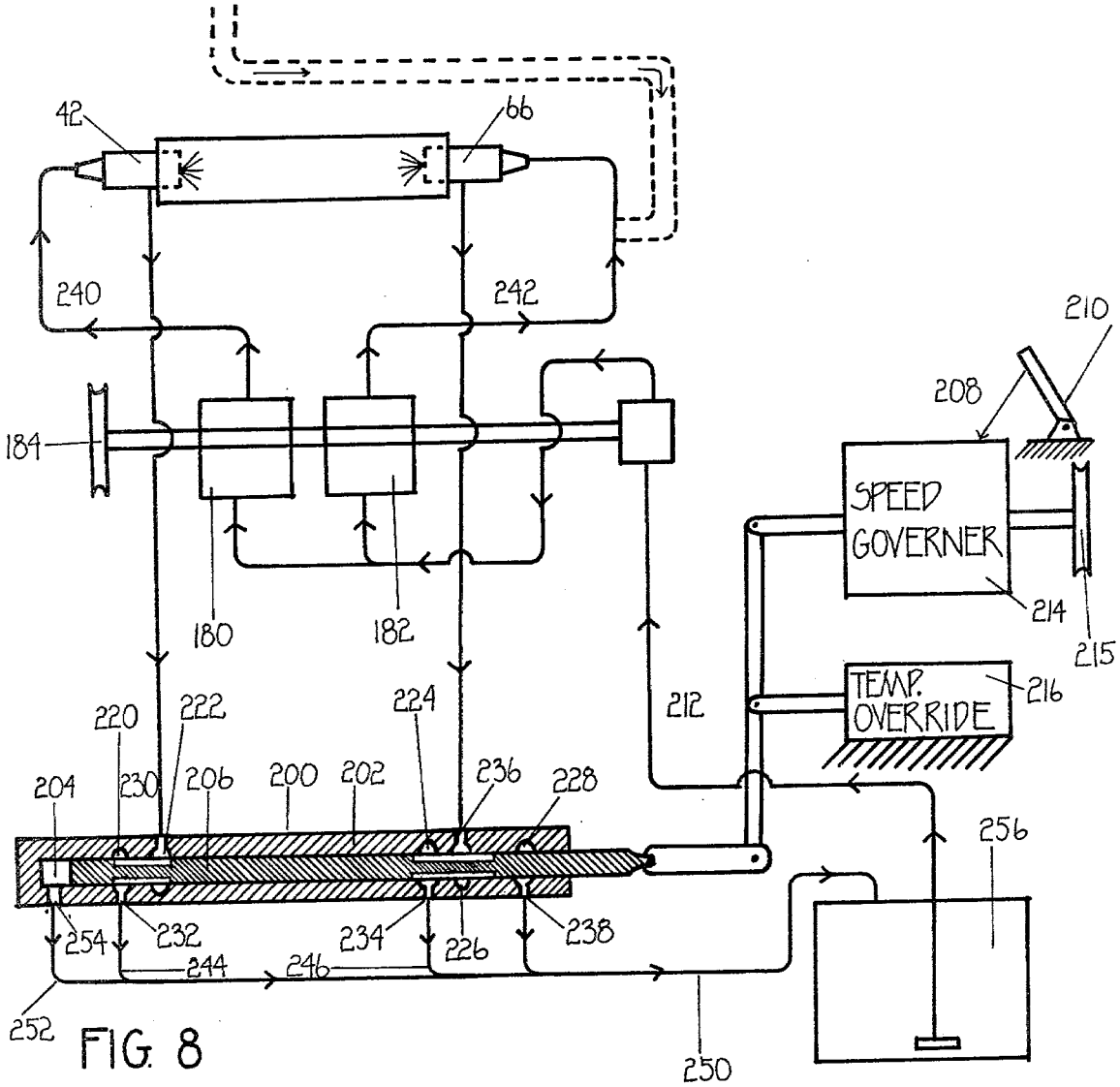
FIG. 8 is a schematic diagram of a suitable control system to effect the supply of fuel in a desired manner by the primary and secondary fuel supply means at the opposite ends of the combustor.
FIG. 9 is a table showing the distribution of air at the various sections A through J of FIG. 1 for the different operating conditions shown by FIGS. 3 through 6.

To achieve this, 8 holes of 1/16 inch diameter are provided in inlet plate 30 around injector #1 in two rows, 8 1/32 inch diameter holes are also provided around each of the ten sections of the inner liner 14, and 8 slanting slots $\frac{1}{8}$ inch by 65 mils are provided in the plate 50 at the end of flame tube 14. The holes are all directed 45° downstream with 4 directed tangentially at 30° and 4 at 45°. The holes are arranged so as to give the optimum rotational energy to the combustion gases and at the same time to secure enough radial penetration to keep the CO and CH's down. The table of FIG. 9 shows the distribution of air at the various regions A through J of the combustor at the different operating conditions shown in FIGS. 3 through 6.

FIG. 3 illustrates operation of the combustor at about 13% wide open throttle (WOT) correspondng to about 9 H (30 m.p.h.). At idle the flame will be only about ⅓ of this volume. This illustrates the need for not having too much incoming air at this point, but the over rich primary condition of the flame near the primary fuel supply means 42 insures stability of combustion.

FIG. 4 shows the elongation of the flame at about 45% wide open throttle (non-supercharged) as the fuel rich gas reaches out along the centerline to get enough air to burn. Also, more wall surface is available to absorb heat and reduce the temperature of the over rich flame.

FIG. 5 illustrates this same reaching out of the flame from the primary fuel supply means 42 at wide open throttle (non-supercharged) showing also how the flame dies out before it reaches the flame which will spontaneously start at the 3000° F. temperature when the secondary fuel supply means 66 injects the remainder of the fuel. The final temperature may be about 3700° F. with about 11 pounds of the air per minute available for cooling the outlet end of the flame tube 14.

Figure 6:
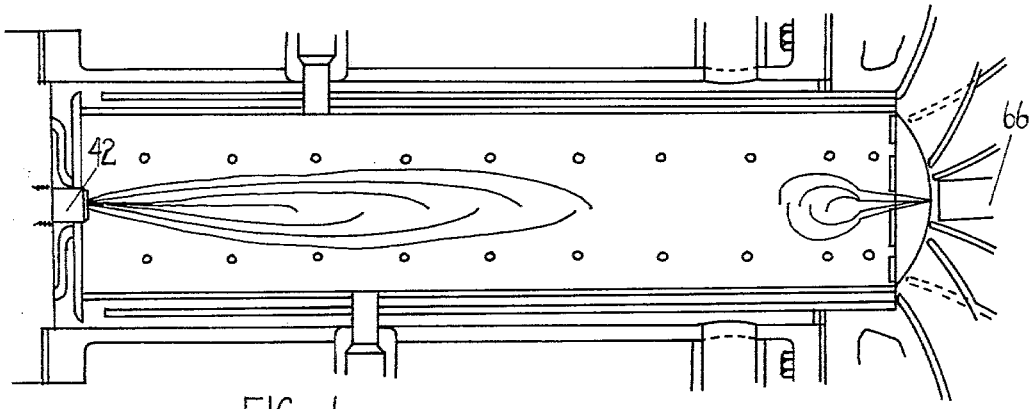
FIG. 6 is a schematic section view of the combustor to illustrate operation thereof at the same horsepower condition as that of FIG. 5 (200 HP) but where supercharging is provided.
Figure 6A:
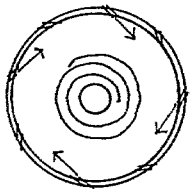

FIG. 6 illustrates the wide open throttle condition and the same horsepower as in FIG. 5 (200 HP), but with supercharging of about 6 psig. This amount of supercharging provides about 34 pounds of air per minute rather than 24.3 pounds as in FIG. 5. Under these conditions, 16 pounds of air per minute is available for cooling the outlet end of flame tube 14. With supercharging, the primary flame is also shorter, and the outlet temperature is about 500° F. lower in spite of the fact that the efficiency of the engine is about 10% better in fuel consumption per HP/HR.

As described, the distribution of the air to the various sections of the combustion chamber is fixed by the area distribution of the various holes 70 leading into the flame tube 14. This is so, however, only so long as the temperature of the air entering the holes is the same. For example, at high loads the air temperature of the holes nearer the exit of flame tube 14 will be higher, and hence this flow will be restricted, and the flow of the various holes further upstream will be increased. This change in the distribution of the air will be such as to reduce the air entering around the primary fuel supply means at the very light load conditions, thus insuring a richer mixture. Conversely this change will increase the air around the primary fuel supply means at higher loads and prevent the mixture getting too rich, which it usually tends to do, and forming carbon at the very high loads.

Figure 7:
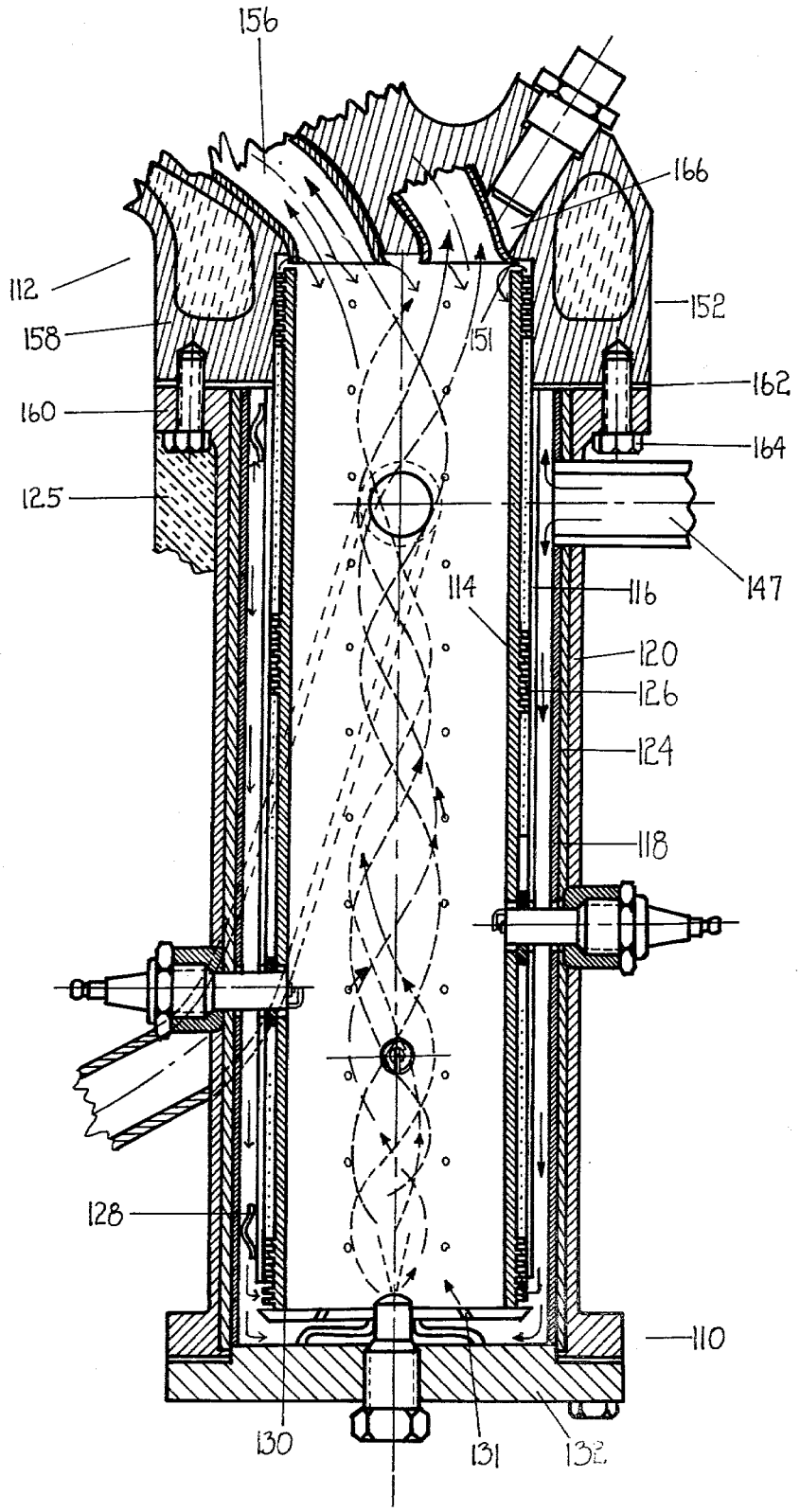
FIG. 7 is a horizontal section view of another embodiment of the invention.

In FIG. 7 there is illustrated a combustor in accordance with another embodiment of the invention. As shown, the combustor has an inlet end 110 and an outlet end 112 and comprises an inner wall or flame tube 114, first and second concentric shell members 116 and 118 disposed in radially spaced relation about the flame tube 114, and an outer housing shell member 120 radially spaced and disposed concentrically about the shell member 118 so as to surround the flame tube 114 and the shell members 116 and 118. The space between tube 114 and tube 116 forms an air passage. The space between outer shell member 120 and shell member 118 is filled with a suitable thermal insulation material 124 to provide a thermally insulated housing to minimize loss of heat from the combustor. In addition, an outer layer 125 of thermal insulation material, only partly illustrated, may be provided around outer housing shell member 120 to still further reduce the heat loss and prevent under-hood heating when the combustor is employed in an automotive application.

The shell member 116 and 118 are held in the desired radial spaced relation by the combination of fin means 126 on the outer surface of flame tube 114 and a plurality of spring members 128 disposed in circumferentially and axially spaced relationship in the space between the shell member 116 and 118. The spring members 128 may be welded or otherwise suitably secured to the shell member 118. Accordingly, the spring members 128 resiliently urge the shell member 116 against the outer surface of fin means 126 and the shell member 118 against the thermal insulation material 124. The resilient support arrangement is simple and convenient and allows for the expansion and contraction of the shell members relative to each other during operation and ease of assembly and maintenance operations.

The inlet end of flame tube 114 is closed by an inlet plate 130 having openings 131 therein while the inlet ends of the shell member 118 and shell 120 are closed by a closure member 132. Openings 131 are suitably angled so that the air supplied to flame tube 114 has a swirling motion imparted to it.

To assure that the expansion and contraction of the flame tube 114 and shell members 116 and 118 does not cause spark plug breakage, the openings for the end of the spark plugs in flame tube 114 and shell members 116 and 118 are made larger than the ends of the spark plugs. A suitable movable seal means may be provided about the openings within the air passage 147.

The outlet end of flame tube 114 is open for supplying hot combustion gases to the utilization apparatus, such as the reciprocating piston engine or gas turbine. In the arrangement illustrated where the combustor is employed with a reciprocating piston engine, the outlet end of the flame tube 114 is shown disposed within a suitable opening 150 of the engine cylinder head 152. The cylinder head 152 is shown as being liquid cooled and includes a plurality of outlet passages 156 which carry the combustion products to the valve-controlled engine cylinders. For example, a suitable inlet valve (not shown) is associated with each of the engine cylinders and controls the flow of the hot combustion products from a passage 156 to the engine cylinder.

Conveniently, cylinder head 152 is provided with a suitable mounting flange 158 to which the flange 160 at the outlet end of outer housing member 120 is secured by a suitable gasket seal 162 and plurality of bolts 164. Also, to provide a convenient means of holding the outlet end of the flame tube 114 and provide for good heat transfer to the cooling liquid of the engine, the end thereof may be fit size-on-size into the opening 150 of the engine cylinder head. As shown, flame tube 114 does not extend all the way to the end of the opening 150 so that air from the air passage 147 exits at the passages 151 just in front of the outlet passages 156 which carry the combustion products to the engine cylinders. This air delivered through the passages 151 is the tertiary combustion air and the outlets may be arranged to deliver about 37% of the total combustion air to the space just in front of the outlet passages 156. A second fuel supply nozzle 166 is provided at the outlet end of the flame tube 114 just in front of the outlet passages 156. Fuel is only supplied through nozzle means 166 to provide for the higher output conditions as described in connection with the embodiment of FIG. 1.

FIG. 8 is a schematic diagram of a suitable system for controlling the fuel supplied by the primary fuel supply means 42 and secondary fuel supply means 66. As shown, the system comprises two fuel pumps 180 and 182. The pumps may be of any suitable type and are preferably constant displacement pumps for a given speed. The pumps 180 and 182 are suitably arranged to provide for maximum flow at the selected ratio between the fuel supply means 42 and 66.

Conveniently pumps 180 and 182 may be driven from the engine crankshaft by any suitable means such as a belt connected with pully 184. Since the fuel requirement is related to the engine speed, this arrangement can conveniently provide for an increasing fuel supply capacity as the engine speed increases and in a manner substantially proportional to the need for fuel. If necessary, due to leakage in the pumps at low speed, it may be desirable to provide the pumps with over-capacity at high speed.

Control of the fuel is achieved by by-passing the excess fuel from the injectors. For example, if injectors 42 and 66 are of the spring closed, outwardly opening type, the injectors will shut off completely when, due to the by-pass opening, the pressure in the oil to the injector drops below the gas pressure in the combustor.

The system includes a control unit 200 comprising a cylinder 202 having a central bore 204. A plunger 206 is reciprocably disposed within the bore 204. Plunger 206 is arranged for reciprocal movement within the bore 204 under control of an accelerator means 208. Accelerator means 208 includes an accelerator pedal 210 and suitable linkage means designated generally at 212. Operatively associated with the linkage means 212 may be a suitable speed governor 214 and temperature overide 216.

Control unit 200 includes a simple two element valve which determines when fuel is by-passed from the injectors 42 and 66. To this end, the cylinder bore 204 is provided with a plurality of port means which are controlled by the position of the plunger. As illustrated, cylinder bore 204 is provided with longitudinally spaced apart annular grooves 220, 222, 224, 226 and 228. An opening 230 is provided in cylinder 202 which communicates with the annular groove 222. Similar openings 232, 234, 236 and 238 are provided in cylinder 202 which communicate respectively with the annular grooves 220, 224, 226 and 228. A fuel line 240 is connected from injector 42 to the opening 230. Similarly, a fuel line 242 is connected from injector 66 to the opening 236. Fuel lines 244, 246 and 248 are connected from the openings 232, 234 and 238 to a fuel return line 250. A line 252 also connects an opening 254 near the end of cylinder bore 204 with the fuel return line 250 which leads to the fuel tank 256.

The ports between the cylinder 202 and the plunger 206 are so arranged and adapted that when the plunger is positioned fully to the right in FIG. 8, both by-pass means are fully opened and no fuel flows out of either injector 42 or 66. As plunger 206 is moved toward the left it first begins to close off the by-pass of injector 42 causing the pressure to rise and the pintle of injector 42 to lift. With the injector 42 open, fuel is supplied to the combustor. The amount of fuel injected is determined by the extent to which the by-pass is closed. When the by-pass to injector 42 is fully closed, no increase in fuel through such injector will occur from further movement of the plunger 206. At this point the position of the plunger is such that the by-pass for injector 66 begins to be closed and the pressure to injector 66 increased until fuel begins to flow through the injector 66 to the combustor. The size and position of the various ports are properly arranged to provide for the desired uniform relation between the position of the plunger and the total fuel flow to the combustor.

If desired the flow of fuel may be under the control of a conventional speed governor driven by the engine. Conveniently, this may be of the type presently employed by the automotive industry. Alternatively, a conventional mechanical governor system of the type used for controlling truck diesel fuel pumps may be employed.

Overrun of the temperature can be prevented, if required, by a suitable exhaust temperature overcontrol 216. In the event the exhaust temperature exceeds a preselected limit as determined by a signal from a suitable sensor (not shown) the plunger 206 will be moved to reduce the amount of fuel supplied to the combustor through injectors 66 and/or 42.

The combustor of this invention is capable of attaining high combustion efficiencies over wide ranges of operating conditions. The provision of regenerative cooling of the flame and swirling of the combustion air permits the combustor to be operated at high equivalence ratios and at high temperatures with the hot combustion products confined to a central core. Since, in addition, the production of oxides of nitrogen in the combustion products is low, the combustor of this invention is particularly useful as a low pollution, external combustor for a suitably cooled reciprocating piston engine such as that disclosed in Warren's U.S. Pat. No. 3,577,729.

In the embodiment of the invention described in connection with FIG. 1, the primary, secondary, and tertiary air was all given a helical motion in the same direction. In such an arrangement the hot gases are confined to the longitudinal center of the combustion chamber due to the swirling action and such narrow hot centrally confined gases extend to the exit end. This is a very desirable and advantageous arrangement for many applications especially for an application with an engine of the type disclosed in the foregoing U.S. Pat. No. 3,577,729.

For certain other applications, such as in a gas turbine, for example, this could be undesirable and it would be preferable to have the combustion spread out at the exit end. That is, a more uniform temperature profile should be provided across the exit end of the combustion chamber to prevent excessive local heating of the turbine buckets.

This more uniform temperature distribution of the combustion gases can be very readily provided in accordance with another embodiment of the invention. In the embodiment the combustor would be constructed in substantially the same manner as that described except that the direction of the helical motion imparted to some of the secondary and to the tertiary air would be made opposite the direction of the helical motion imparted to the primary and secondary air so as to give about zero circular momentum at the entrance to the gas turbine.

Although there has been described what are considered at present to be preferred embodiments of the invention, many modifications and changes may occur to those skilled in the art. Therefore, it is intended that the appended claims cover all such modifications and changes as fall within the true spirit and scope of the invention.

What is claimed and desired to be secured by Letters Patent of the United States is:

1. A low emission prime mover system including an external combustion engine having an intake portion and an exhaust portion; and a combustor, comprising:

(a) a plurality of concentric shells including a flame tube having an inlet end and an exit end, said exit end being connected in fluid communication with said intake portion;

(b) primary means, including a primary fuel and air supply system having fuel and air inlet openings at said inlet end, for establishing thereat a helically swirling, fuel-rich primary combustion flame;

(c) air passage means between said concentric shells and extending about and along the length of said flame tube for (1) regeneratively cooling said flame tube and the primary combustion flame therein, and (2) conveying selected amounts of regeneratively heated air to said flame tube in a helically swirling motion at a plurality of regions intermediate said inlet and exit ends to cool the combustion products of said flame and provide for secondary combustion of any unburned fuel supplied by said primary fuel supply means;

(d) secondary means including a secondary fuel and air supply system having fuel and air inlet openings at said exit end; and (e) automatic fuel control means for regulating fuel flow to said primary means in a quantity less than that required for full load operation, and for regulating the fuel flow to said secondary means in a continuous flow as required to achieve a desired higher load operating condition without subjecting the inlet end of said flame tube to the otherwise high temperature, heavy combustion load, and resulting production of $NO_x$.

2. The system defined in claim 1, wherein said automatic fuel control means allocates about 40% to 60% of the fuel required for full load operation to said secondary means.

3. The system defined in claim 2, wherein said air passage means includes tertiary air supply means for providing regeneratively heated air to said exit end in a helically swirling flow for cooling and tertiary combustion.

4. The combustor recited in claim 1, including thermal insulation means operative to reduce the heat loss from said combustor, said thermal insulation means including a layer of thermal insulation disposed in the space defined between a pair of adjacent concentric cylindrical shells.

5. The system recited in claim 1, wherein said air passage means includes helically disposed fin means disposed between said shells for enhancing said swirling motion of said regeneratively heated air and for enhancing the cooling effect of said air in said passage means.

6. A combustor for a low emission external combustion prime mover system, comprising:

a plurality of concentric radially spaced shells having an inlet end and exit end;

primary fuel and air supply means disposed at said inlet end and operative to supply fuel and air thereto of less than the quantity required for full load operation; secondary fuel supply means disposed at said exit end and operative to supply the remainder of the fuel in a continuous flow needed to attain up to full load operation; and air supply and cooling passage means including the space between adjacent walls of said shells for conveying air for secondary combustion and regenerative cooling of said shells.

7. The combustor recited in claim 6, wherein said primary fuel and air supply means is arranged to supply about 40% to 60% of the fuel required for full load operation.

8. The combustor recited in claim 6, wherein the approximate distribution of air to the innermost shell is 15% for primary combustion, 4% to 10% for flame stabilization, 40% in the regions intermediate the inlet and exit ends for cooling or secondary combustion and 35% at the exit end for cooling and/or tertiary combustion.

9. The combustor recited in claim 6 wherein said air supply and cooling passage means includes tertiary air supply means for supplying regeneratively heated air to said exit end of said combustor in a swirling flow, including fin means arranged in axially spaced-apart groups on the outside surface of the innermost shell in helical disposition and extending into said space between adjacent walls of said shells.

10. The combustor recited in claim 6, wherein said supply and cooling means includes a plurality of circumferentially spaced axially, tangentially, and radially directed openings in the wall of the innermost shell for supplying selected amounts of swirling air to the interior of the innermost shell at a plurality of regions intermediate the inlet and exit ends thereof, and at the exit thereof.

* * * * *